US008182067B2

(12) United States Patent
Kamoda et al.

(10) Patent No.: US 8,182,067 B2
(45) Date of Patent: May 22, 2012

(54) DROPLET DISCHARGE HEAD AND DROPLET DISCHARGING UNIT INCORPORATING THE SAME

(75) Inventors: Hitoshi Kamoda, Kanagawa (JP); Manabu Tomita, Kanagawa (JP); Iwao Ushinohama, Kanagawa (JP); Soichi Kuwahara, Kanagawa (JP); Shigeyoshi Hirashima, Kanagawa (JP)

(73) Assignee: Sony Corporation, Tokyo (JP)

( * ) Notice: Subject to any disclaimer, the term of this patent is extended or adjusted under 35 U.S.C. 154(b) by 6 days.

(21) Appl. No.: 12/507,964

(22) Filed: Jul. 23, 2009

(65) Prior Publication Data

US 2010/0026764 A1 Feb. 4, 2010

(30) Foreign Application Priority Data

Jul. 29, 2008 (JP) ..... 2008-194316

(51) Int. Cl.
*B41J 2/14* (2006.01)

(52) U.S. Cl. ..... 347/47; 347/65; 347/63; 347/44; 347/54

(58) Field of Classification Search ..... 347/47, 347/65, 63, 54, 46, 44
See application file for complete search history.

(56) References Cited

U.S. PATENT DOCUMENTS

| | | | | |
|---|---|---|---|---|
| 6,158,843 | A * | 12/2000 | Murthy et al. | 347/47 |
| 6,371,600 | B1 * | 4/2002 | Murthy et al. | 347/63 |
| 6,986,980 | B2 * | 1/2006 | Kubota et al. | 430/156 |
| 7,204,574 | B2 * | 4/2007 | Bertelsen et al. | 347/20 |
| 2004/0036751 | A1 * | 2/2004 | Giere et al. | 347/93 |

FOREIGN PATENT DOCUMENTS

| | | | |
|---|---|---|---|
| JP | 03-297651 | | 12/1991 |
| JP | 05-077437 | | 3/1993 |
| JP | HEI 08-267747 | A | 10/1996 |
| JP | 09-187950 | * | 7/1997 |

* cited by examiner

*Primary Examiner* — Matthew Luu
*Assistant Examiner* — Henok Legesse
(74) *Attorney, Agent, or Firm* — SNR Denton US LLP

(57) ABSTRACT

A droplet discharge head includes: a liquid reservoir which holds a liquid; a channel through which the liquid is guided to the liquid reservoir; and a driving element which changes the pressure in the liquid reservoir so as to discharge droplets of the liquid contained in the liquid reservoir through a nozzle, in which wall surfaces of the liquid reservoir and of the nozzle are arranged in a continuous line at a side opposite the channel with respect to the center of the nozzle as seen in a cross-sectional view through a central axis of the nozzle.

7 Claims, 13 Drawing Sheets

DROPLET DISCHARGE HEAD AND DROPLET DISCHARGING UNIT INCORPORATING THE SAME

BACKGROUND OF THE INVENTION

1. Field of the Invention

The present invention relates to a droplet discharge head and a droplet discharging unit incorporating the same, which may be included in a printer. Each of wall surfaces of a liquid reservoir and of a nozzle may be formed in a linear configuration as seen in a cross-sectional view or each of the wall surfaces may have a width narrowing toward an orifice so that, at a connecting portion of the liquid reservoir and the nozzle, the nozzle is wider than the liquid reservoir. With this configuration, the likelihood of malfunctions caused by ingress of air bubbles, dust or other foreign matter into the liquid reservoir may be reduced.

2. Description of the Related Art

Inkjet print heads discharge ink stored in an ink reservoir when a driving element changes the pressure in the ink reservoir. The driving element may include a piezoelectric element or a heater element.

A print head with a heater element as a driving element may be fabricated in the following manner. First, a drive circuit of the heater element, a heater element and other components may be sequentially mounted on a semiconductor substrate. Partition walls of ink reservoirs and of an ink channel may then be mounted on the semiconductor substrate by, for example, photolithography using photosensitive epoxy resin. A nozzle sheet, which is a sheet-like component on which nozzles are arranged, is provided on the semiconductor substrate. The ink reservoirs, the ink channel, the nozzles and other components may alternatively be integrated with one another.

Japanese Unexamined Patent Application Publication (JP-A) No. 5-77437 discloses, for example, a print head with a system for preventing nozzle clogging.

Printers suffer from a problem that defective printing may be caused by ingress of air bubbles, dust or other foreign matter into an ink reservoir. Recent printers have small nozzles for high quality and high resolution printing. Such fine nozzles may be a cause of defective printing.

In order to address this problem, a method disclosed in No. JP-A-5-77437 may be employed to periodically check defective printing. It is necessary, however, to frequently checking defective printing and the defective printing may not completely be eliminated. Defective printing may not be checked while a paper sheet is under going printing. Consequently, such a related art process is still impractical.

SUMMARY OF THE INVENTION

It is desirable to provide a droplet discharge head and a droplet discharging unit incorporating the same, which reduce the likelihood of malfunctions caused by ingress of air bubbles, dust or other foreign matter into the liquid reservoir.

According to a first embodiment of the invention, there is provided a droplet discharge head which includes: a liquid reservoir which holds a liquid; a channel through which the liquid is guided to the liquid reservoir; and a driving element which changes the pressure in the liquid reservoir so as to discharge droplets of the liquid contained in the liquid reservoir through a nozzle, in which wall surfaces of the liquid reservoir and of the nozzle are arranged in a continuous line at a side opposite the channel with respect to the center of the nozzle as seen in a cross-sectional view through a central axis of the nozzle.

According to a second embodiment of the invention, there is provided a droplet discharge head which includes: a liquid reservoir which holds a liquid; a channel through which the liquid is guided to the liquid reservoir; and a driving element which changes the pressure in the liquid reservoir so as to discharge droplets of the liquid contained in the liquid reservoir through a nozzle, wherein a wall surface of the liquid reservoir and a wall surface of the nozzle are linearly configured such that the width of the liquid reservoir and the width of the nozzle decrease toward a tip of the nozzle and that the width of the nozzle is wider at a connection portion of the liquid reservoir and the nozzle at a side opposite the channel with respect to the center of the nozzle as seen in a cross-sectional view through a central axis of the nozzle.

According to a third embodiment of the invention, there is provided a droplet discharging unit which includes a liquid discharging head for discharging desired droplets of a liquid, the liquid discharging head including: a liquid reservoir which holds the liquid; a channel through which the liquid is guided to the liquid reservoir; and a driving element which changes the pressure in the liquid reservoir so as to discharge the droplets through a nozzle, wherein wall surfaces of the liquid reservoir and of the nozzle are arranged in a continuous line at a side opposite the channel with respect to the center of the nozzle as seen in a cross-sectional view through a central axis of the nozzle.

According to a fourth embodiment of the invention, there is provided a droplet discharging unit which includes a liquid discharging head for discharging desired droplets of a liquid, the liquid discharging head including: a liquid reservoir which holds the liquid; a channel through which the liquid is guided to the liquid reservoir; and a driving element which changes the pressure in the liquid reservoir so as to discharge the droplets through a nozzle, wherein a wall surface of the liquid reservoir and a wall surface of the nozzle are linearly configured such that the width of the liquid reservoir and the width of the nozzle decrease toward a tip of the nozzle and that the width of the nozzle is wider at a connection portion of the liquid reservoir and the nozzle at a side opposite the channel with respect to the center of the nozzle as seen in a cross-sectional view through a central axis of the nozzle.

According to the configurations of the first and third embodiments of the invention, air bubbles, dust or other foreign matter coming into the liquid reservoir may hardly remain there and may easily be expelled through the nozzle. Malfunctions otherwise caused by the air bubbles, dust or other foreign matter existing in the liquid reservoir may be reduced.

According to the configurations of the second and fourth embodiments of the invention, by appropriately selecting an area having an increased width at the connecting portion, formation of projections that impede the ink flow may be prevented even if the components at the side of the nozzle are displaced with respect to the components of the partition of the ink reservoir. With these configurations, air bubbles, dust or other foreign matter coming into the liquid reservoir may hardly remain there and may easily be expelled through the nozzle. Malfunctions otherwise caused by the air bubbles, dust or other foreign matter existing in the liquid reservoir may be reduced.

According to the invention, malfunctions caused by ingress of air bubbles, dust or other foreign matter into the liquid reservoir may be reduced.

DESCRIPTION OF THE PREFERRED EMBODIMENTS

Figure 1A:
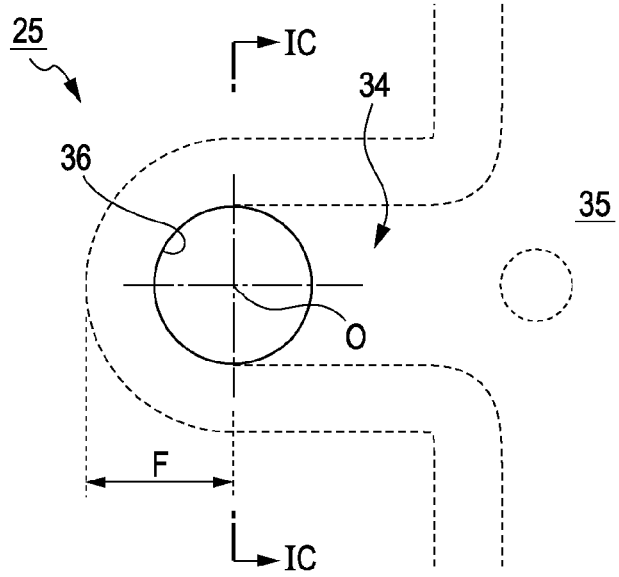
FIGS. 1A to 1C illustrate a print head chip incorporated in a printer according to a first embodiment of the invention.

Referring now to the drawings, embodiments of the invention will be described in detail.

First Embodiment

1. Configuration of Embodiments

1-1. Overall Structure

Figure 2:
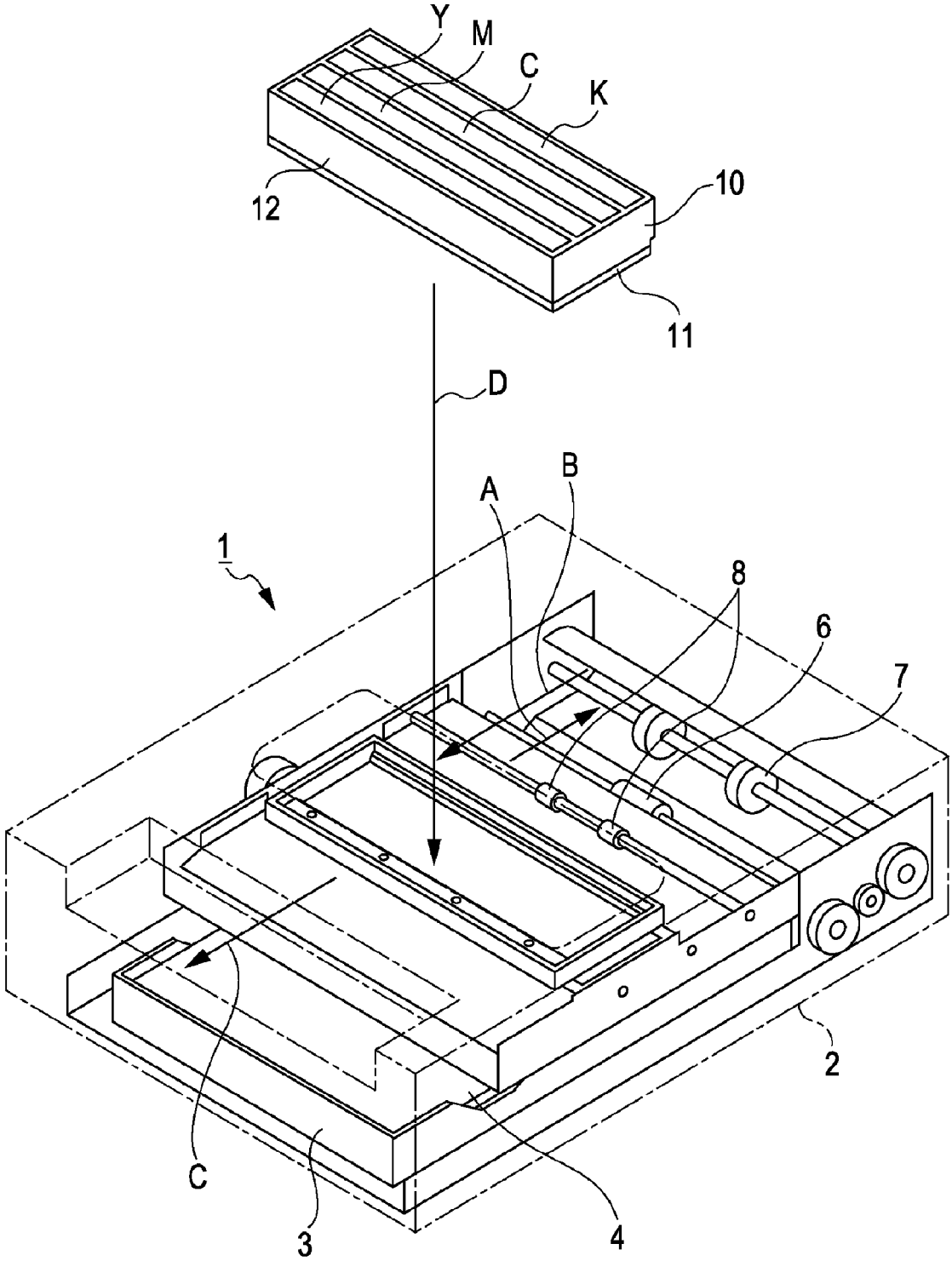
FIG. 2 is a perspective view of a printer in accordance with the first embodiment of the invention.

FIG. 2 is a perspective view of a printer 1 according to a first embodiment of the invention. The printer 1 is a line printer whose components are accommodated in a rectangular housing 2. A sheet tray 3 is inserted in a tray port provided at the front of the housing 2.

A paper sheet 4 on the sheet tray 3 is made to abut a feed roller 6 by means of a predetermined mechanism. Upon rotation of the feed roller 6, the paper sheet 4 is transported toward the back side of the printer 1 as indicated by arrow A. A reverse roller 7 is provided downstream in the feeding direction of the paper sheet 4. Upon rotation of the reverse roller 7, the paper sheet 4 is transported toward the front side of the printer 1 as indicated by arrow B.

The paper sheet 4 moving in the reverse direction is then transported by a spur roller 8 across the sheet tray 3 and then discharged from a discharge port at the front side of the printer 1 as shown by arrow C. A print head cartridge 10 is removably provided between the spur roller 8 and the discharge port. The print head cartridge 10 may be set as shown in an arrow D.

The print head cartridge 10 includes a holder 12 of a predetermined configuration with a print head 11 disposed at a lower side thereof. The print head 11 discharges ink droplets of yellow (Y), magenta (M), cyan (C) and black (K). Ink cartridges for the colors of Y, M, C and K are disposed on the holder 12. The printer 1 causes the print head 11 to discharge ink droplets onto the paper sheet 4 under transportation in order to print, for example, a desired image.

1-2. Print Head Configuration

Figure 3:
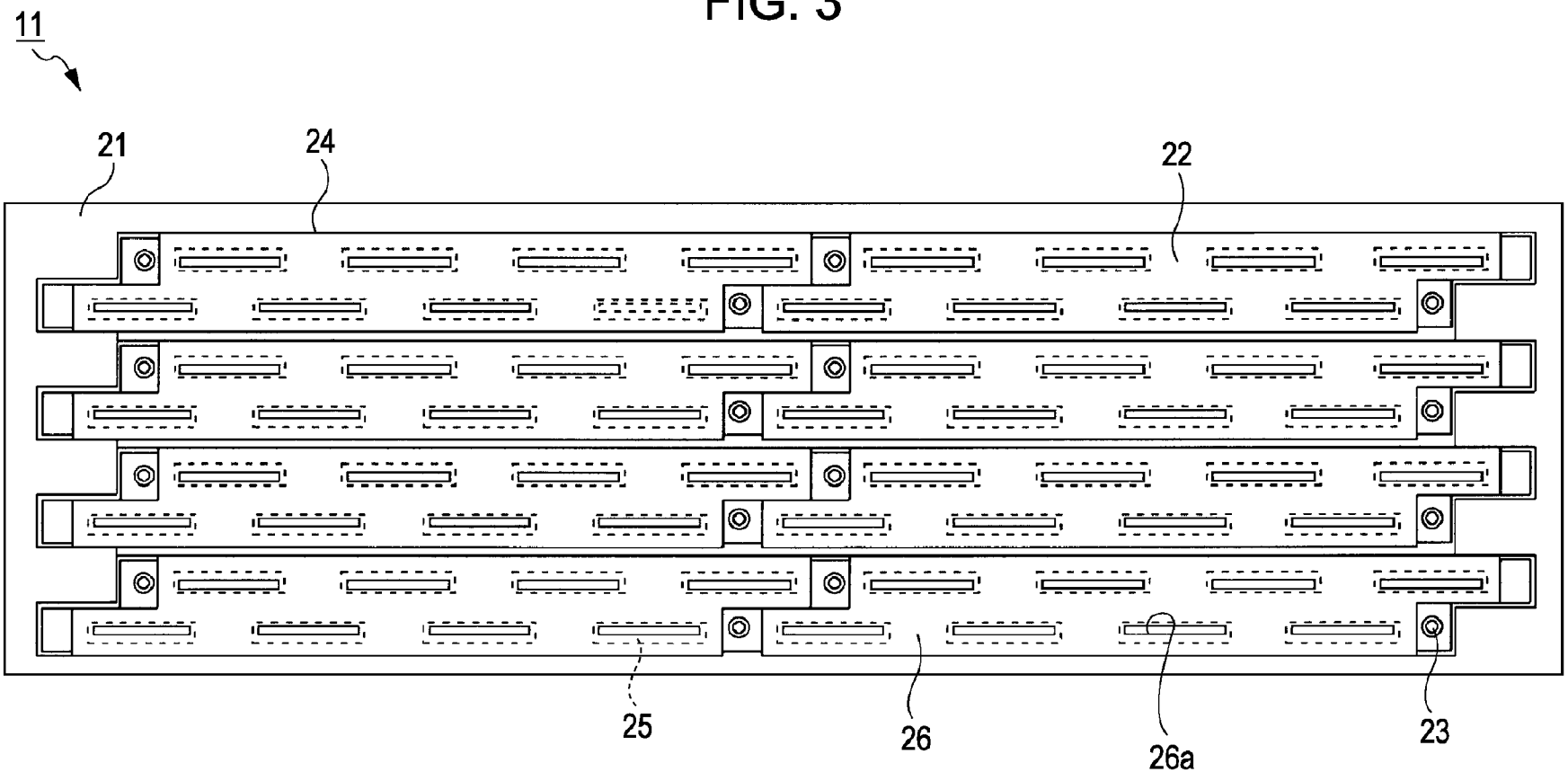
FIG. 3 is a plan view showing a print head incorporated in the printer of FIG. 2.

FIG. 3 is a plan view of the print head 11 seen from below. The print head 11 is constituted by multiple print head modules 22 fixed to a print head frame 21 with screws 23. The print head frame 21 serves as a holder of the print head modules 22. The print head frame 21 is formed of a metal plate having a predetermined thickness. The print head frame 21 has four elongated holes 24 extending perpendicularly to the direction in which the paper sheet is transported. The elongated holes 24 are arranged parallel to one another along the direction in which the paper sheet is transported. The arranged elongated holes 24 have a total length corresponding to the printing width of the print head 11 and have a certain width.

Each of the print head modules 22 is a unit constituted by integrated multiple print head chips 25. In the present embodiment, each of the print head modules 22 is formed by integrated multiple print head chips 25 such that a single color of ink may be printed in half of a printing width of the print head 11. Two print head modules 22 are provided in each elongated hole 24 in the print head frame 21. Eight print head modules 22 in total are provided in the print head 11 so as to allow printing on a DIN A4-sized paper sheet 4.

In particular, each of the print head modules 22 is fabricated in the following manner. The print head chips 25 are first mounted on a print head chip holder (not shown) disposed on the lower side of the head frame 21. The print head chips 25 are connected to a flexible wiring board 26. A main ink channel which guides the ink contained in the ink cartridges to the print head chips 25 is formed in the print head chip holder. The print head chips 25 are driven by the flexible wiring board 26. The flexible wiring board 26 has rectangular openings 26*a* at positions where the print head chips 25 are to be formed. A nozzle array provided in the print head chips 25 is exposed through the openings 26*a*. The flexible wiring board 26 is connected to the print head chips 25 by electrodes disposed along the openings 26*a*.

Each of the main ink channels is formed in the print head chip holder at the substantial center of the width of a corresponding one of the elongated holes 24 so as to extend along the longitudinal direction of the elongated hole 24. The print head chips 25 are arranged in an alternating pattern with the main ink channels disposed therebetween.

1-3. Print Head Chip Configuration

Figure 4:
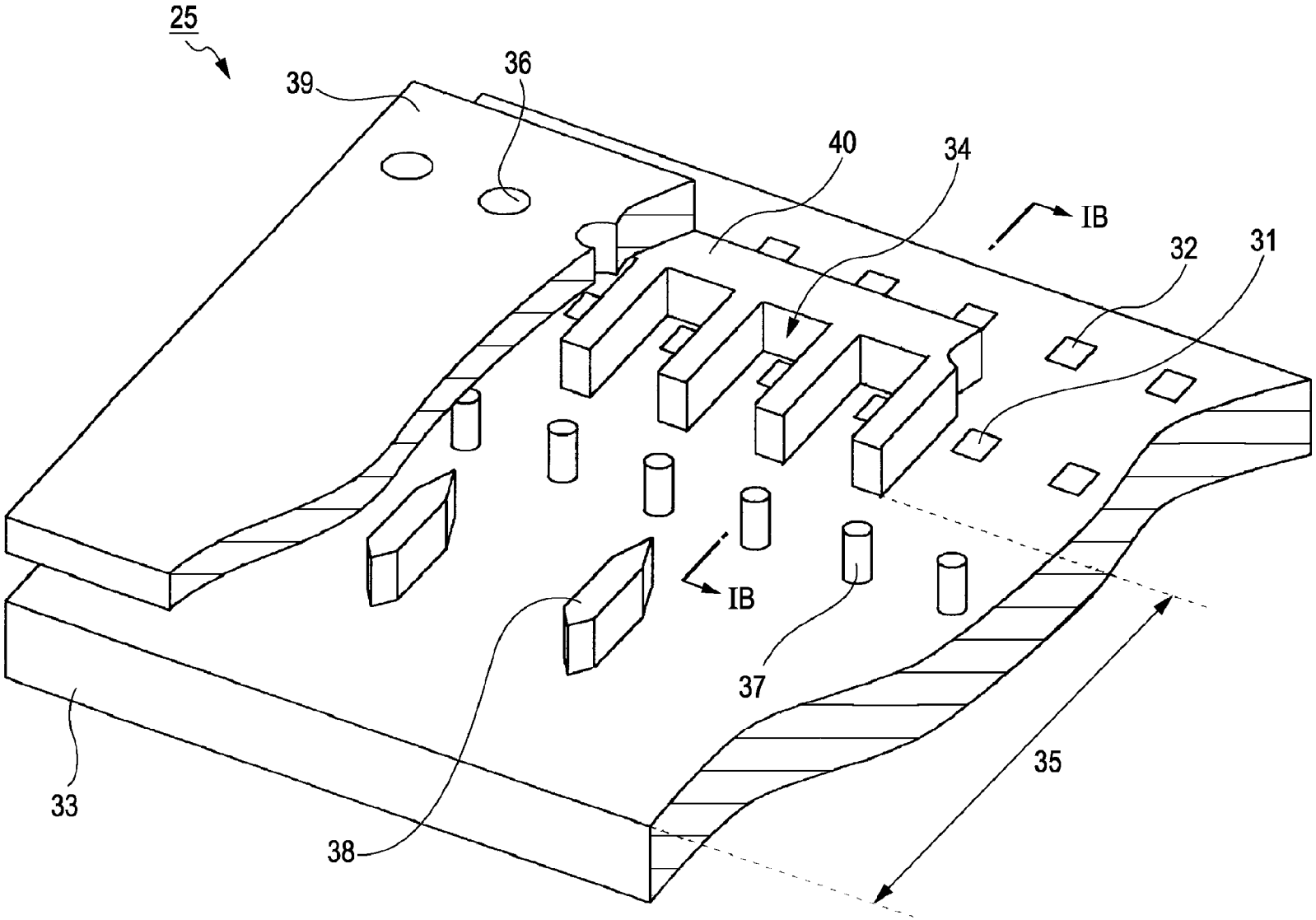
FIG. 4 is a perspective view of a print head chip incorporated in the print head shown in FIG. 3.

FIG. 4 is a detailed, partially cutaway perspective view of one of the print head chips 25. The print head chip 25 includes a semiconductor substrate 33 on which heater elements 31, a driving circuit for driving the heater elements 31, electrodes 32 to which the flexible wiring board 26 is to be connected and other components are provided. The semiconductor substrate 33 also includes ink reservoirs 34, an ink channel 35 and nozzles 36.

The semiconductor substrate 33 includes multiple heater elements 31 which are continuously arranged at constant intervals along the main ink channel. Each heater element 31 includes the ink reservoir 34.

The ink channel 35 is defined as a section of an ink channel which guides the ink supplied from the main ink channel to each ink reservoir 34. The ink channel 35 corresponds to a certain range from an end surface of the main ink channel of the semiconductor substrate 33. The ink channel 35 is a space having a certain width defined by the semiconductor substrate 33 and an opposite top plate 39. The ink channel 35 includes circular columns 37 disposed in front of the ink reservoirs 34 for preventing interference between adjacent ink reservoirs 34, the circular columns 37 providing and provide a space in the height direction of the ink channel 35. Similarly, prismatic columns 38 are provided at the side of the main ink channel of the columns 37 to provide a space in the height direction of the ink channel 35. Each of the columns 38 extends along the direction in which the ink flows such that a profile thereof seen from the ink reservoir 34 side is significantly smaller than that a profile seen from the perpendicular direction. With this configuration, the columns 38 prevent increase in channel resistance.

The ink reservoirs 34 are defined by a partition 40 disposed in an area other than the ink channel 35 and by a top plate 39 disposed on an upper surface of the partition 40. The nozzles 36 are formed in the top plate 39.

Figure 1B:
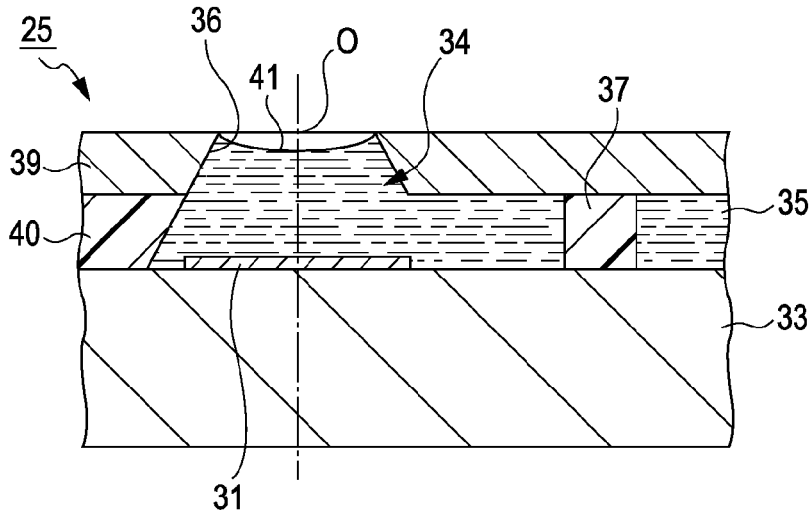
Figure 1C:
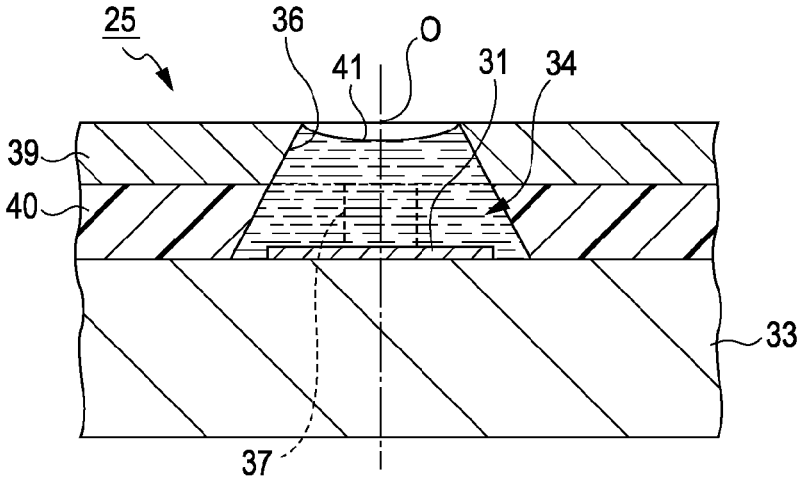

FIG. 1A is a partially enlarged cross-sectional view, and FIGS. 1B and 1C are plan views of one of the ink reservoirs 34. FIG. 1B is a cross-sectional view taken along line IB-IB in FIG. 4. FIG. 1C is a cross-sectional view taken along line IC-IC in FIG. 1A. The print head chip 25 is formed such that wall surfaces of the liquid reservoir 34 and of the nozzle 36 are arranged in a continuous line at a side opposite the ink channel 35 with respect to the center O of the nozzle 36 as seen in a cross-sectional view through a central axis of the nozzle as denoted by the reference letter F. In particular, each of the wall surfaces of the liquid reservoir 34 and of the nozzle 36 is formed in a linear configuration with each width narrowing toward an orifice from a bottom surface side of the ink reservoir 34 in the section denoted by F. Thus, each of wall surfaces of the liquid reservoir 34 and of the nozzle 36 is reversely tapered. With this configuration, the likelihood of malfunctions of the print head 11 caused by ingress of air bubbles, dust or other foreign matter into the liquid reservoir may be reduced by facilitating the ink flow at an opposite side of the ink channel 35 of the ink reservoir 34 where the air bubbles, dust or other foreign matter may often remain.

The print head chip 25 is reversely tapered toward the orifice from the bottom surface side at the wall surface of the ink reservoir 34 facing the ink channels 35 except for the area denoted by F. With this configuration, the print head chip 25 facilitates the ink flow to prevent malfunction of the nozzles caused by ingress of air bubbles, dust or other foreign matter.

1-4. Manufacturing Process of Print Head Chips

In the present embodiment, the semiconductor substrate 33 includes the semiconductor wafer on which the multiple print head chips 25 are collectively provided in a semiconductor manufacturing process. A sacrificial layer 46 is then formed to conform to the ink reservoir 34 and the ink channel 35. A resin material is deposited to cover the sacrificial layer 46 so as to form the partition 40 and the top plate 39. The sacrificial layer 46 is then removed to provide the ink reservoir 34 and the ink channel 35. The partition 40 and the top plate 39 are thus integrally formed.

The wall surfaces of the ink reservoir 34 and of the nozzle 36 are formed in the above-described configuration when exposed to provide the sacrificial layer 46. The print head chips 25 are then isolated by scribing.

Figure 5:
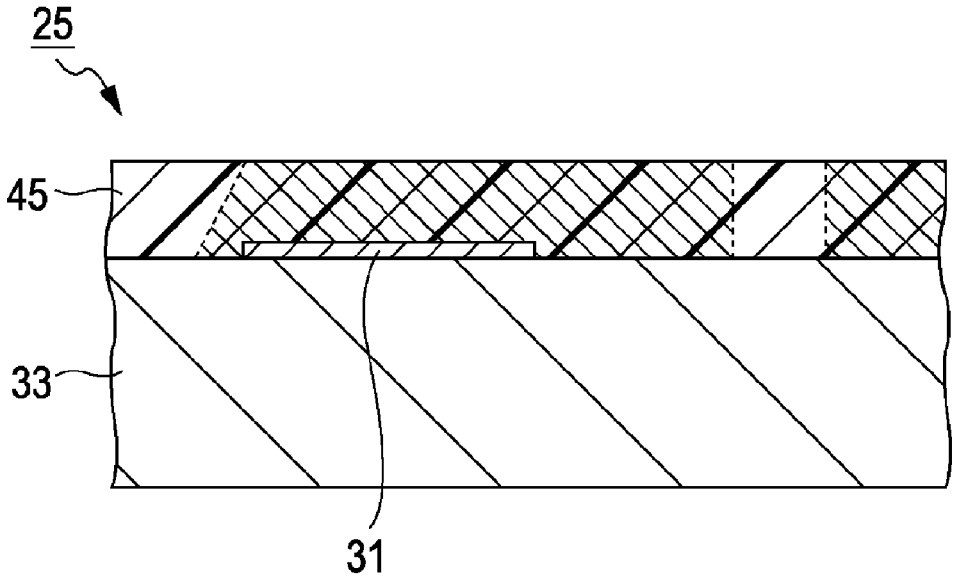
FIG. 5 is a cross-sectional view illustrating fabrication of the print head chip shown in FIG. 1B.

FIG. 5 is a cross-sectional view illustrating fabrication of the print head chip 25 corresponding to FIG. 1B. In the foregoing description, the print head chip 25 is provided by first collectively fabricating multiple print head chips and then isolating each chip. In the following drawings, however, a procedure of fabrication of the print head chip is shown for each semiconductor substrate 33 for ease of illustration.

Fabrication of the print head chip 25 may include formation of the heater elements 31, the drive circuit for driving the heater elements 31 and other components on a semiconductor wafer to provide the semiconductor substrate 33 and then application of a positive photoresist 45 (e.g., PMER-LA900 manufactured by Tokyo Ohka Kogyo Co., Ltd.) on the semiconductor substrate 33 by spin coating. In the present embodiment, the positive photoresist 45 has a thickness of 10 micrometers. The heater elements 31 are fabricated from a tantalum layer.

Figure 6:
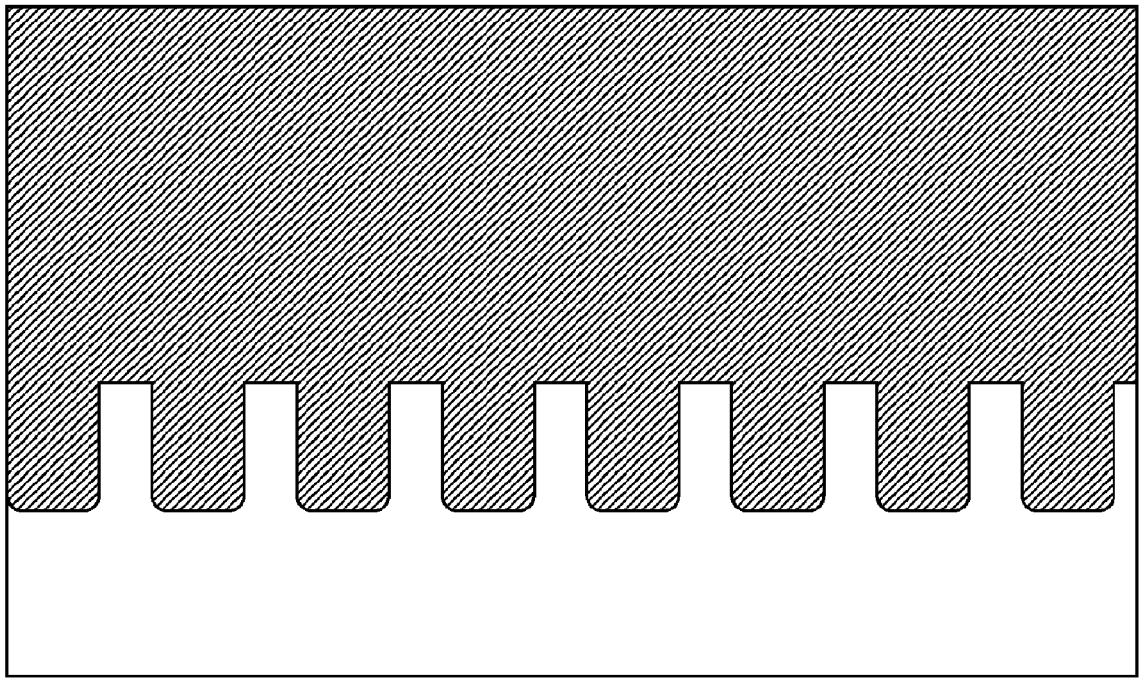
FIG. 6 is a plan view of a mask for the ink reservoir used in fabrication of the print head chip shown in FIG. 1.
Figure 7:
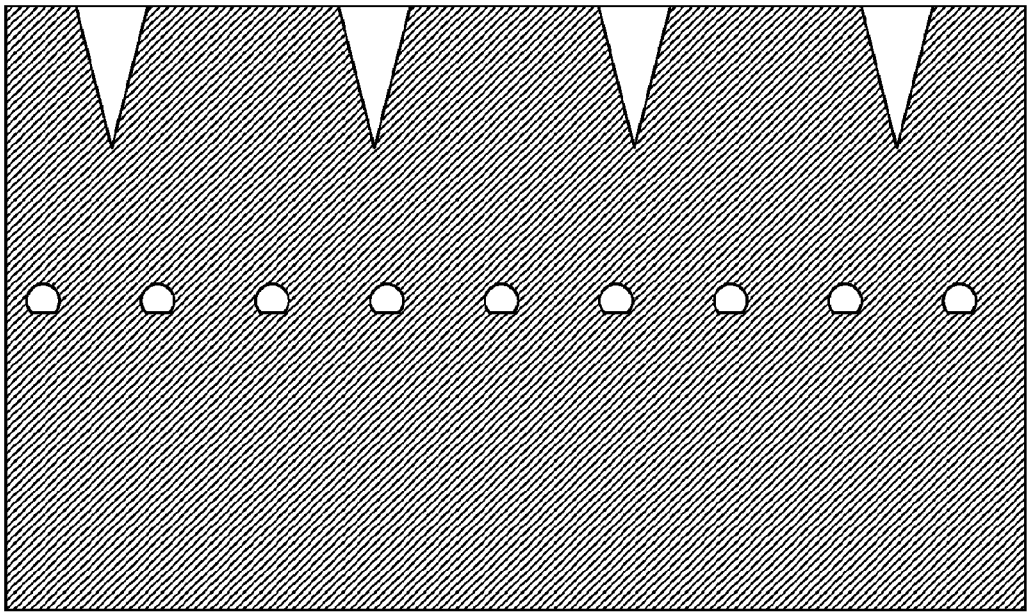
FIG. 7 is a plan view of a mask for the ink channel used in fabrication of the print head chip shown in FIG. 1.
Figure 8:
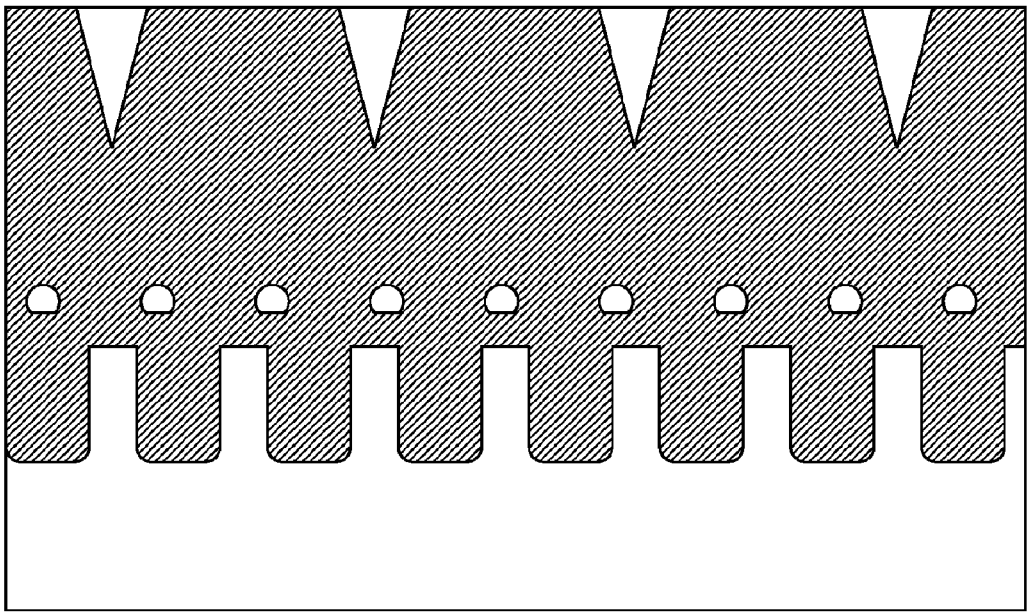
FIG. 8 is a plan view of a mask that may replace those masks shown in FIGS. 6 and 7.

The positive photoresist 45 is then exposed by using a stepper through a mask corresponding to the configuration of the ink reservoir 34. The mask used herein is shown in FIG. 6 in which a shielded area is hatched. The positive photoresist 45 is then exposed by using the stepper through a mask corresponding to the configuration of the ink channel 35. The mask used herein is shown in FIG. 7 in correspondence with FIG. 6. The ink channel 35 may be exposed prior to the ink reservoir 34. Alternatively, the ink channel 35 and the ink reservoir 34 may alternatively be exposed at the same time through a single mask as shown in FIG. 8 in correspondence with FIGS. 6 and 7.

In at least the process of exposing the ink reservoir 34, a focusing position is shifted from the surface of the semiconductor substrate 33 toward the inside of the semiconductor substrate 33. In this manner, the positive photoresist 45 is exposed in a tapered manner corresponding to the configuration of the wall surface of the ink reservoir 34. In FIG. 5, unexposed areas are hatched. It is at least necessary to properly design the mask used for exposing the ink reservoir 34 according to the thickness of the positive photoresist 45, the shift amount of the focusing position, the diameter and thickness of the nozzle 36 or other parameters so that the wall surfaces of the ink reservoir 34 and the nozzle 36 may be formed in a linear configuration.

In particular, the positive photoresist 45 is exposed using an i-line stepper NSR-2005i9C manufactured by Nikon Corporation at an irradiance level of 1200 mJ/cm$^2$. The shift amount of the focusing position is 10 micrometers. Instead of the stepper, an aligner may be employed to expose the mask and the substrate in a superimposed manner. In this manner, the positive photoresist 45 may similarly be tapered with the mask disposed apart from the positive photoresist 45 by a certain distance.

Figure 9:
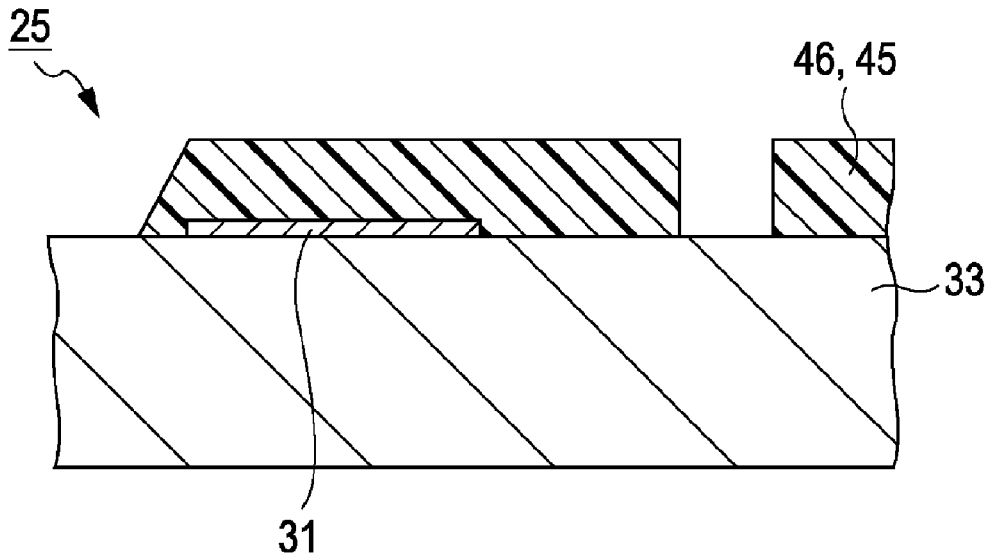
FIG. 9 is a cross-sectional view illustrating a process subsequent to that shown in FIG. 5.

The substrate is then subjected to paddle development for 3 minutes with a developing agent of 3% solution of hydroxylation tetramethyl ammonium (TMAH). The developed subject is then rinsed with pure water and spin dried. In this manner, a sacrificial layer 46 is provided to conform to the ink reservoir 34 and the ink channel 35 by the positive photoresist 45 as shown in FIG. 9.

Figure 10:
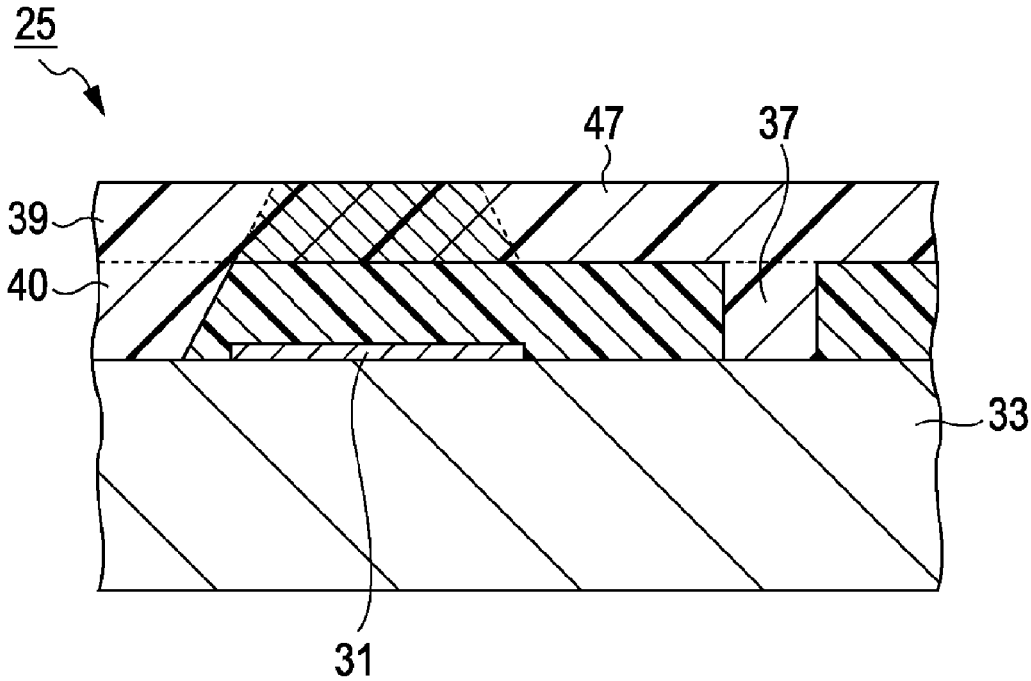
FIG. 10 is a cross-sectional view illustrating a process subsequent to that shown in FIG. 9.

Subsequently, a predetermined resin material is applied to the substrate to form a coating layer 47 and then the nozzle 36 is fabricated as shown in FIG. 10. In the present embodiment, the resin material is a light-curable negative photoresist. The negative photoresist is applied at a thickness of 10 micrometers by spin coating to form the coating layer 47. The coating layer 47 is then exposed by using the stepper through a mask corresponding to the nozzle 36 and the coating layer 47 is exposed according to the configuration of the nozzle 36. For the exposure, as in the exposure of the ink reservoir 34, a focusing position is shifted such that the coating layer 47 is exposed in a tapered manner corresponding to the wall surface configuration of the nozzle 36. The mask is properly designed according to the thickness of the coating layer 47, the shift amount of the focusing position, the diameter and the thickness of the nozzle 36 or other parameters so that the wall surfaces of the ink reservoir 34 and the nozzle 36 may be formed in a linear configuration. The coating layer 47 is exposed using an i-line stepper NSR-2005i9C manufactured by Nikon Corporation at an irradiance level of 1200 mJ/cm$^2$. The shift amount of the focusing position is 10 micrometers. In FIG. 10, the exposed area is hatched.

The coating layer 47 is then developed with a developing agent (OK73 thinner: manufactured by Tokyo Ohka Kogyo Co., Ltd.). The developed coating layer 47 is then rinsed with isopropyl alcohol to fabricate a nozzle 36 in the coating layer 47.

Each of the print head chips 25, after being isolated by scribing, is immersed in a predetermined solution so as to remove the sacrificial layer 46. Any solution may be employed that may remove the sacrificial layer 46. In the present embodiment, an organic solvent of propylene glycol monoethyl ether acetate (PGMEA) is used. The print head chip 25 is then subjected to supersonic vibration when immersed in the solution to remove the sacrificial layer 46. The solution is replaced by isopropyl alcohol and the print head chip 25 is then dried. In this manner, the ink reservoir 34 and the ink channel 35 are fabricated.

2. Operation of Embodiment

In the thus-configured printer 1 (see FIG. 2), the print head cartridge 10 is driven according to image data, text data or other data used for printing. The printer head 11 provided at the print head cartridge 10 discharges ink droplets, which will be deposited on the to-be-recorded paper sheet 4 while being transported by a predetermined mechanism. An image, text or the like is printed on the paper sheet 4 with the deposited ink droplets.

In the print head 11 (see FIGS. 3 and 4), ink in the ink cartridges of Y, M, C and K is guided to the ink reservoirs 34 of the print head chips 25. The pressure in the ink reservoirs 34 is changed by the heater element 31 disposed in each of the ink reservoirs 34 so that the ink in the ink reservoirs 34 is discharged as ink droplets from the nozzles 36.

Air bubbles, dust or other foreign matter may often be included in the ink. Ingress of the air bubbles, dust or other foreign matter into the ink reservoirs 34 makes it difficult to stably discharge ink from the nozzles 36 which may lead to defective printing. In particular, in recent years, it has become a common demand to reduce the diameter of the ink droplets discharged from nozzles in order to obtain high resolution images. It is therefore necessary to reduce nozzle diameter. In order to reliably deposit ink droplets discharged from nozzles to a to-be-printed sheet, however, it is also necessary to provide a certain degree of discharge rate or discharging power.

Such a print head may have a profile such that the ink reservoir size is substantially larger the nozzle diameter, which may cause easy ingress of air bubbles, dust or other foreign matter in the ink reservoir.

In the printer 1 (see FIG. 1), wall surfaces of the ink reservoir 34 and of the nozzle 36 are arranged in a continuous line at a side opposite the ink channel 35 with respect to the center O of the nozzle 36 as seen in a cross-sectional view through a central axis of the nozzle 36. In particular, each of wall surfaces of the liquid reservoir 34 and of the nozzle 36 is formed in a linear configuration with each width narrowing toward an orifice from a bottom surface side of the ink reservoir 34 in this section. Thus, each of wall surfaces of the liquid reservoir 34 and of the nozzle 36 is reversely tapered.

With this configuration, the ink reservoir 34 has no recess or stepped portion that may otherwise facilitate ingress of air bubbles, dust or other foreign matter into the ink reservoir 34 and thus the air bubbles, dust or other foreign matter which entered the ink reservoir 34 may be expelled promptly from the nozzle 36. The print head 11 according to the present embodiment may therefore include automatic restoration to the defective printing due to air bubbles, dust or other foreign matter. With this configuration, malfunctions caused by ingress of air bubbles, dust or other foreign matter into the ink reservoir 34 may be reduced.

Ingress of air bubbles, dust or other foreign matter may occur more frequently in a section at a side opposite the ink channel 35 with respect to the center O of the nozzle 36 than a section at the side of the ink channel 35 of the center O of the nozzle 36. In the present embodiment, since wall surfaces of the liquid reservoir 34 and of the nozzle 36 are arranged in a linear configuration as seen in a cross section, malfunctions of the print head 11 caused by ingress of air bubbles, dust or other foreign matter into the liquid reservoir 34 may reliably be reduced.

The wall surfaces of the liquid reservoir 34 and of the nozzle 36 are formed to have the width narrowing, i.e., reversely tapered, toward the orifice from the bottom surface side of the ink reservoir 34. With this configuration, obstacles that may prevent refilling operation may be eliminated.

In the present embodiment (see FIGS. 5 to 9), corresponding to the configurations of the ink reservoir 34 and the nozzle 36, the semiconductor substrate 33 on which the heater element 31, the driving circuit for driving the heater element 31 and other components are formed is first fabricated. The positive photoresist 45 is then applied onto the semiconductor substrate 33. The positive photoresist 45 is exposed and developed to provide the sacrificial layer 46 that conforms to the configurations of the ink reservoir 34 and the ink channel 35. The configuration of the wall surface of the ink reservoir 34 is determined by the focusing set during exposure.

Subsequently, a light-curable negative photoresist is applied to form the coating layer 47, which is then exposed and developed to provide the nozzle 36 (see FIG. 10). The wall surface configuration of the nozzle 36 is determined by the setup of the mask and focusing during exposure. The print head chip 25 is then isolated and the sacrificial layer 46 is removed to provide the ink reservoir 34 and the ink channel 35.

As described above, in the configuration in which the ink reservoir, the ink channel and the nozzle are fabricated through exposure and development using the sacrificial layer and a coating layer according to the present embodiment, malfunctions caused by ingress of air bubbles, dust or other foreign matter into the liquid reservoir 34 may be reduced by properly setting exposure conditions or other conditions. Accordingly, malfunctions caused by ingress of air bubbles, dust or other foreign matter into the liquid reservoir 34 may be reduced with a simple structure.

3. Effect of Embodiment

With the foregoing configuration, since the wall surfaces of the liquid reservoir and of the nozzle are arranged in a linear configuration as seen in a cross section, malfunctions caused by ingress of air bubbles, dust or other foreign matter into the liquid reservoir may be reduced.

Reversely tapered wall surfaces of the ink reservoir and of the nozzle may also reduce malfunctions caused by ingress of air bubbles, dust or other foreign matter into the liquid reservoir.

After the sacrificial layer which conforms to the configurations of the ink reservoir and the ink channel is provided, the coating layer is deposited which will then be exposed and developed to fabricate the nozzle. The sacrificial layer is then removed to provide the ink reservoir and the ink channel. Since the wall surfaces of the liquid reservoir and of the nozzle are arranged in a linear configuration as seen in a cross section with the focusing condition or other conditions during exposure being properly determined, malfunctions caused by ingress of air bubbles, dust or other foreign matter into the liquid reservoir may be reduced with the simple structure.

Second Embodiment

In the present embodiment, the print head chip is fabricated in the following manner. A partition of an ink reservoir, a column of an ink channel and other components are first formed on a semiconductor substrate. A nozzle sheet, which is a sheet-like component on which nozzles are arranged, is provided on the semiconductor substrate. A top plate 39 and the partition 40 in the present embodiment are provided separately. The printer according to the present embodiment is configured in the same manner as in the first embodiment except for the fabrication process of the print head chips. In the following description, similar components will be denoted by similar reference numerals as in the first embodiment.

Figure 11A:
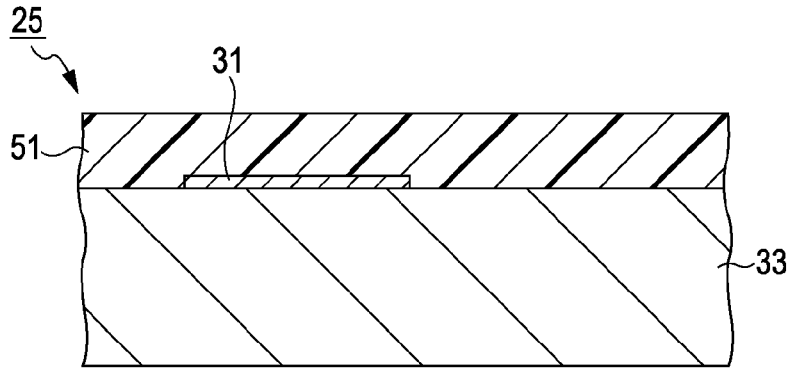
FIGS. 11A to 11C are cross-sectional views illustrating fabrication of a print head chip incorporated in the printer according to a second embodiment of the invention.
Figure 11B:
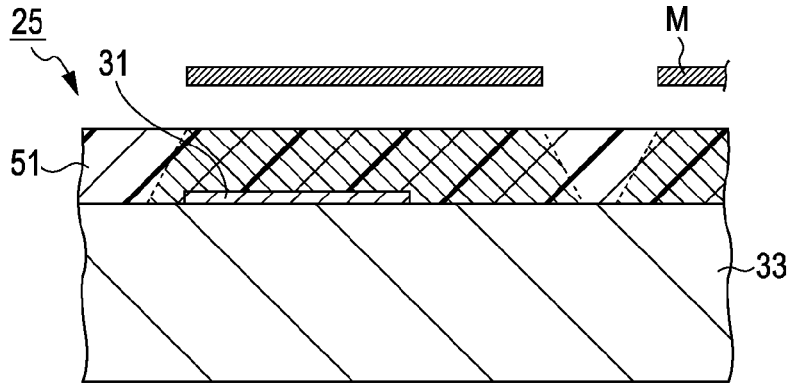

As shown in FIG. 11A, a print head is fabricated in the following process. Negative resist 51 is first applied to a semiconductor substrate 33 by spin coating. Then, as shown in FIG. 11B, the negative resist 51 is exposed through a mask M which shields areas corresponding to an ink reservoir 34 and an ink channel 35. The negative resist 51 may be photosensitive cyclized rubber. If necessary, a surface of the semiconductor substrate 33 may be treated or modified in order to improve adhesion intensity with the negative resist 51. In the exposure process, a focusing position may be offset as in the first embodiment so that the print head is exposed in a reversely tapered manner to conform to the configuration of the wall surface of the ink reservoir.

Figure 11C:
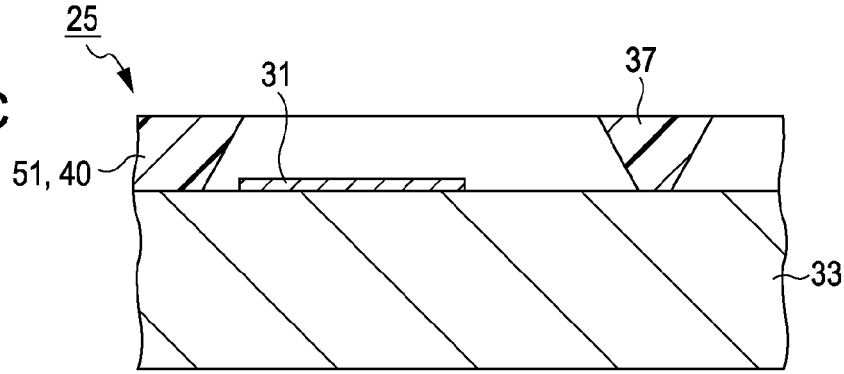

The negative resist 51 is developed using a predetermined developing agent, solvent or other agent to remove unexposed areas as shown in FIG. 11C. In this manner, a partition of the ink reservoir 34 and columns 37 and 38 of the ink channel 35 are formed on the semiconductor substrate 33, which may provide a partition 40.

Figure 12:
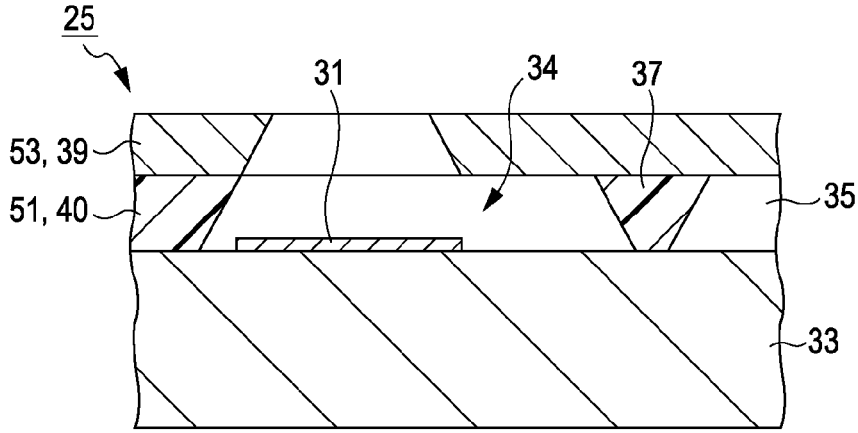
FIG. 12 is a cross-sectional view illustrating a process subsequent to that shown in FIG. 11.

Subsequently, a separately prepared nozzle sheet 53 is aligned with and made to adhere onto the negative resist 51 as shown in FIG. 12. The nozzle sheet 53 is disposed through secondary adhesion of the negative resist 51.

The nozzle sheet 53 is fabricated in the following manner. Negative resist 52 is applied to a certain thickness onto a substrate made of, for example, stainless steel having conductivity by spin coating. The negative resist 52 is exposed and developed through a mask corresponding to the configuration of the nozzle 36. In this manner, a mold of the configuration of the nozzle 36 is formed on the substrate. In the exposure process for fabricating a nozzle plate, as in the fabrication of the sacrificial layer according to the first embodiment, a focusing position may be offset so that the print head is reversely tapered to conform to the configuration of the wall surface of the nozzle 36. The wall surfaces of the ink reservoir 34 and of the nozzle 36 may be formed in a continuous linear configuration.

The substrate is then subjected to an electroforming process in a plating bath so as to form a nozzle sheet on the substrate. The nozzle sheet 53 is removed from the substrate, is subjected to a series of processing including washing, and then disposed on the print head chip 25.

As described above, if the top plate 39 and the partition 40 are separately provided to form the print head chip, the same effect as that of the first embodiment may be obtained.

Third Embodiment

In fabrication of a print head chip according to the present embodiment, a nozzle configuration is determined by a sacrificial layer. A printer according to the present embodiment has the same configuration as that of the first embodiment except for the fabrication process of the print head chip. In the following description, similar components will be denoted by similar reference numerals as in the first embodiment.

Figure 13:
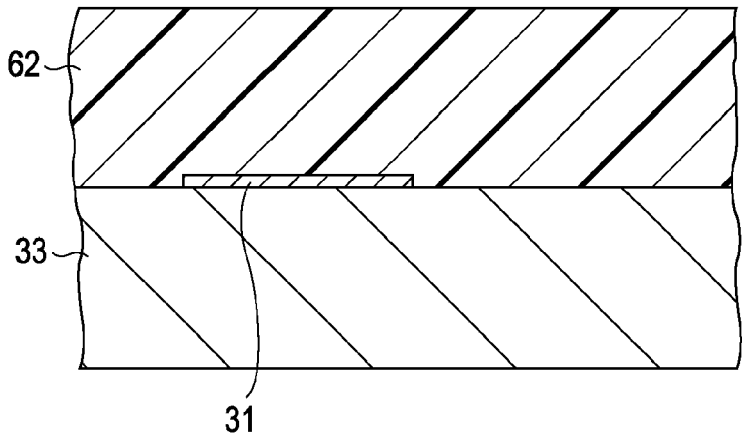
FIG. 13 is a cross-sectional view illustrating fabrication of a print head chip incorporated in a printer according to a third embodiment of the invention.

As shown in FIG. 13, positive resist 62 is applied onto a semiconductor substrate 33 by spin coating. In the present embodiment, the positive resist 62 is applied to the thickness greater than the total thickness of the ink reservoir 34 and of the nozzle 36.

Figure 14A:
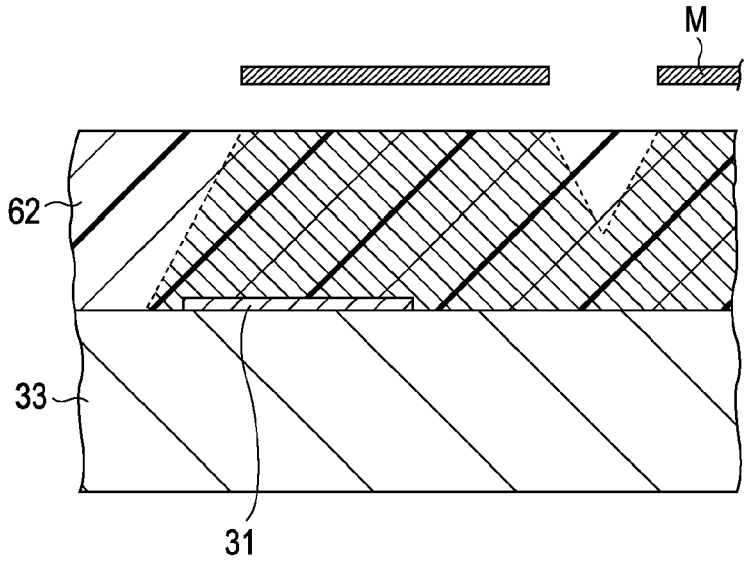
FIGS. 14A and 14B are cross-sectional views illustrating a process subsequent to that shown in FIG. 13.

The positive resist 62 is exposed through a mask M which shields areas corresponding to the ink reservoir 34 and the ink channel 35 as shown in FIG. 14A. In the present embodiment, a focusing position may be offset as in the first embodiment so that the print head is exposed in a reversely tapered manner to conform to the configuration of the wall surface of the ink reservoir.

Figure 14B:
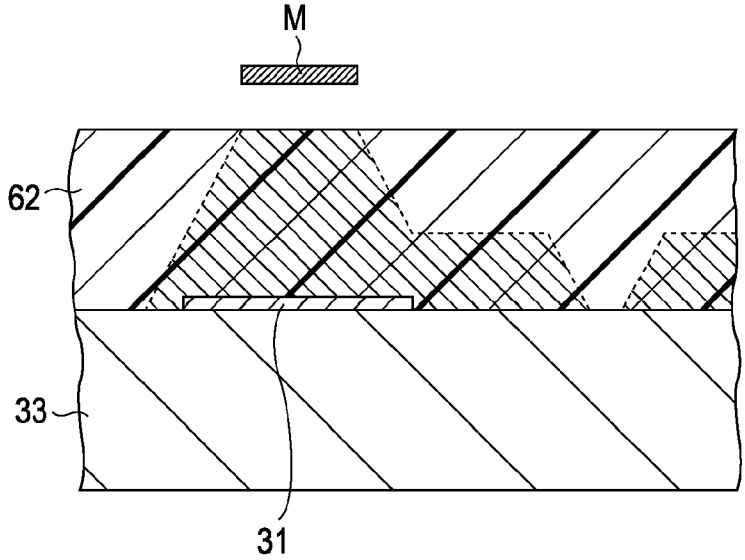

The positive resist 62 is exposed through the mask M which shields areas corresponding to the nozzle 36 as shown in FIG. 14B. In this exposure process, as in the first embodiment, a focusing position may be offset so that the print head is exposed in a reversely tapered manner to conform to the configuration of the nozzle 36. The mask M is selected such that the wall surfaces of the ink reservoir 34 and of the nozzle 36 may be formed in a continuous linear configuration.

Figure 15A:
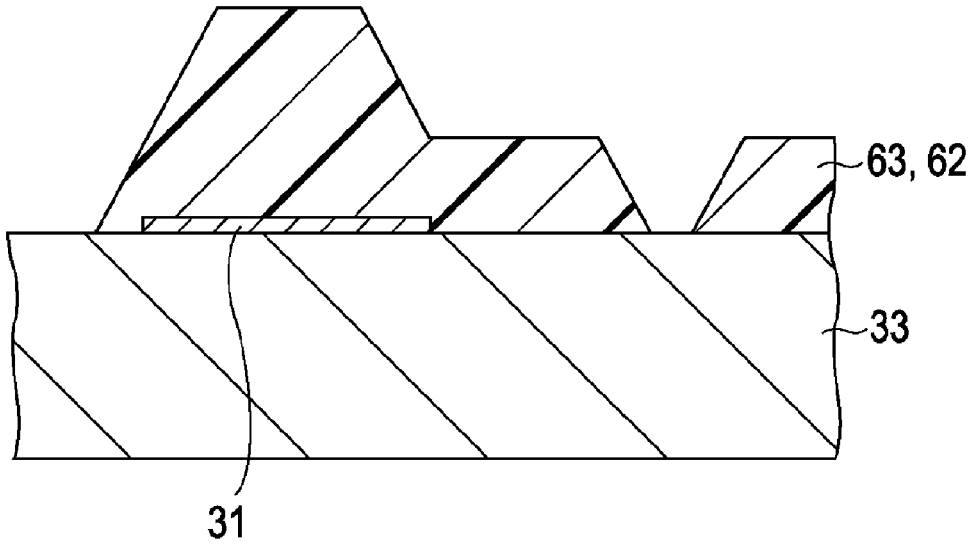
FIGS. 15A and 15B are cross-sectional views illustrating a process subsequent to that shown in FIG. 14.

The exposed area of the positive resist 62 is removed with a predetermined solvent to remove the sacrificial layer 63 which conforms to the configurations of the nozzle 36, the ink reservoir 34 and the ink channel 35 as shown in FIG. 15A.

Figure 15B:
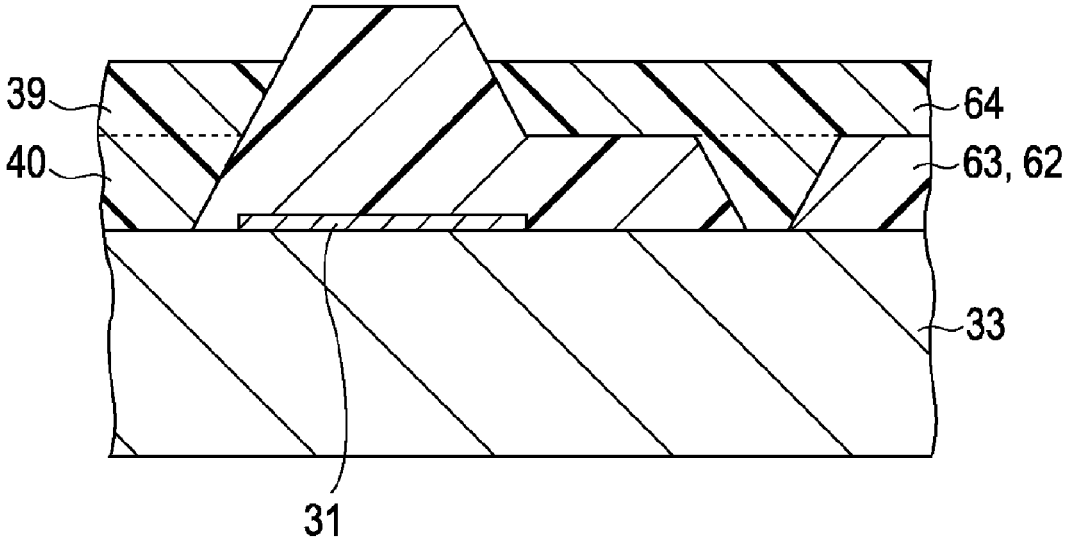

A coating layer 64 of UV-curable epoxy resin is applied to a predetermined thickness as shown in FIG. 15B and is then cured. The sacrificial layer 63 is subsequently removed to provide the nozzle 36, the ink reservoir 34 and the ink channel 35.

As described above, if the nozzle configuration is determined by the sacrificial layer, the same effect as that of the first embodiment may be obtained.

Fourth Embodiment

Figure 16A:
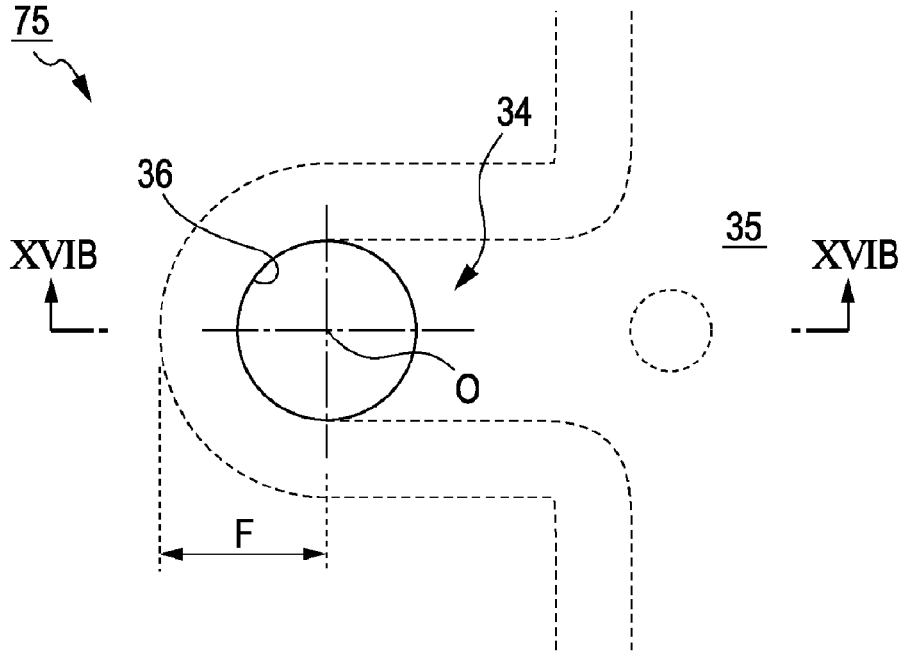
FIGS. 16A and 16B are cross-sectional views illustrating fabrication of a print head chip incorporated in a printer according to a fourth embodiment of the invention.
Figure 16B:
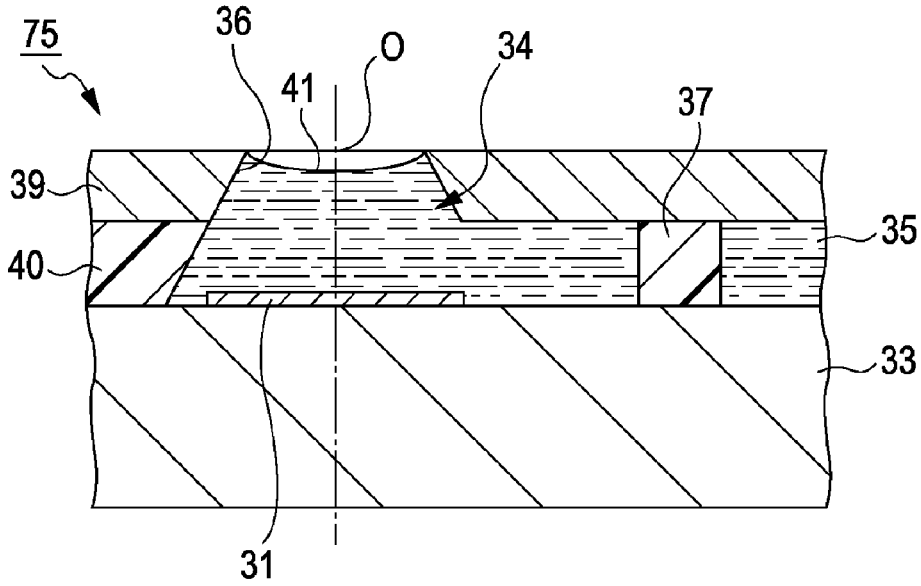

FIG. 16A is a cross-sectional view and FIG. 16B is a plan view of a print head chip incorporated in a printer according to a fourth embodiment of the invention corresponding to FIGS. 1A and 1B. A print head chip 75 according to the present embodiment has a round bottom surface of an ink reservoir 34 seen from a nozzle 36 side with a center O of the nozzle 36 at a side opposite to an ink channel 35 with respect to the center of the nozzle 36. The print head chip 75 may therefore have uniformly inclined wall surfaces of the ink reservoir 34 and of the nozzle 36 at the opposite side of the ink channel 35 with respect to the center of the nozzle 36. The print head chip 75 according to the present embodiment is the same as those of the foregoing embodiments except for the configurations of the nozzles 36 and the ink reservoir 34. The configuration of the ink reservoir is not particularly limited to those described.

The same effects as those in the foregoing embodiments may be obtained in the present embodiment, even if the ink reservoir has a round configuration.

Fifth Embodiment

Figure 17A:
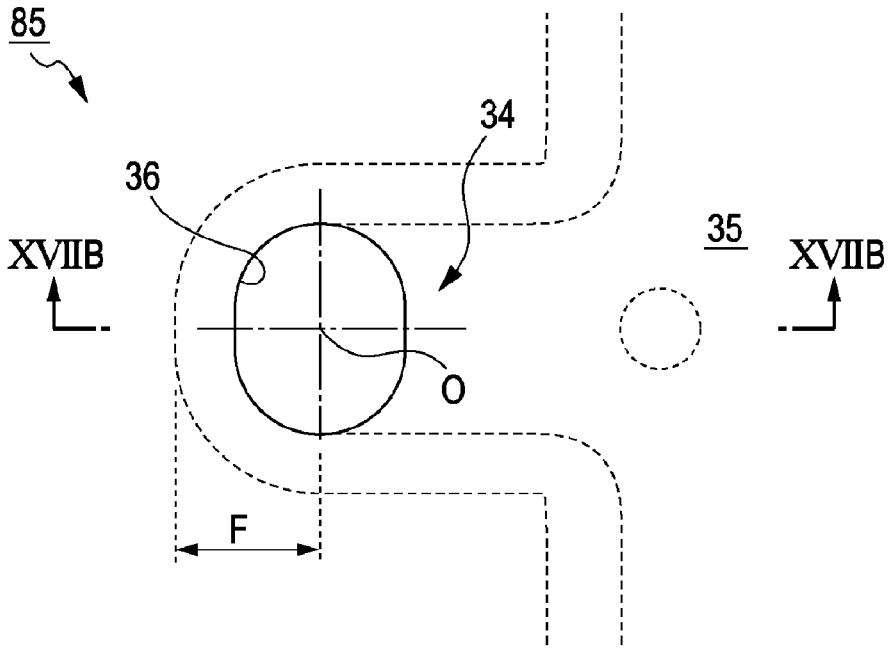
FIGS. 17A and 17B are cross-sectional views illustrating fabrication of a print head chip incorporated in a printer according to a fifth embodiment of the invention.
Figure 17B:
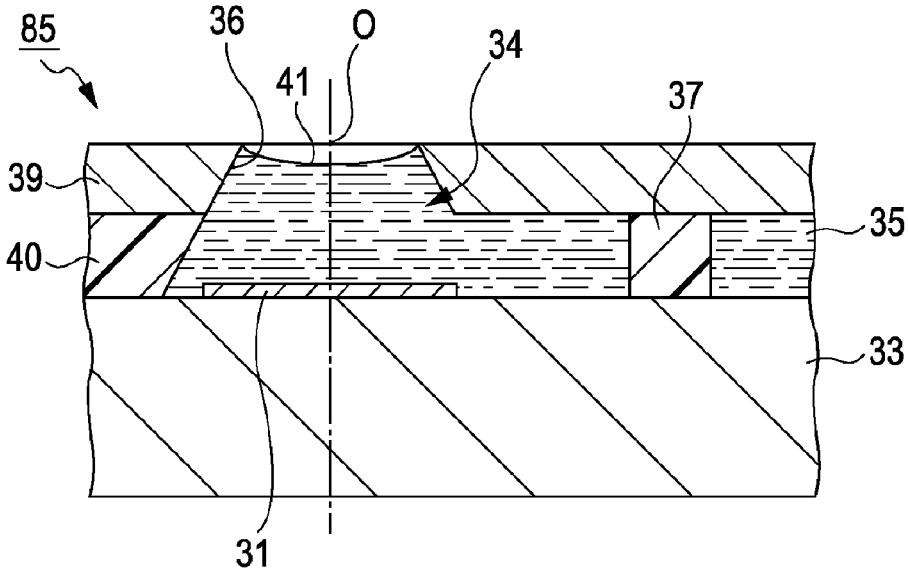

FIG. 17A is a cross-sectional view and FIG. 17B is a plan view of a print head chip incorporated in a printer according to a fifth embodiment of the invention corresponding to FIGS. 1A and 1B. In a print head chip 85 according to the present embodiment, a nozzle 36 is formed as an ellipse and an ink reservoir 34 is fabricated corresponding to the configuration of the nozzle 36. The print head chip 85 according to the present embodiment is the same as those of the foregoing embodiments except for the configurations of the nozzle 36 and the ink reservoir 34. The configuration of the nozzle 36 is not particularly limited to those described.

The same effects as those in the foregoing embodiments may be obtained in the present embodiment, even if the nozzle is formed as an ellipse.

Sixth Embodiment

Figure 18A:
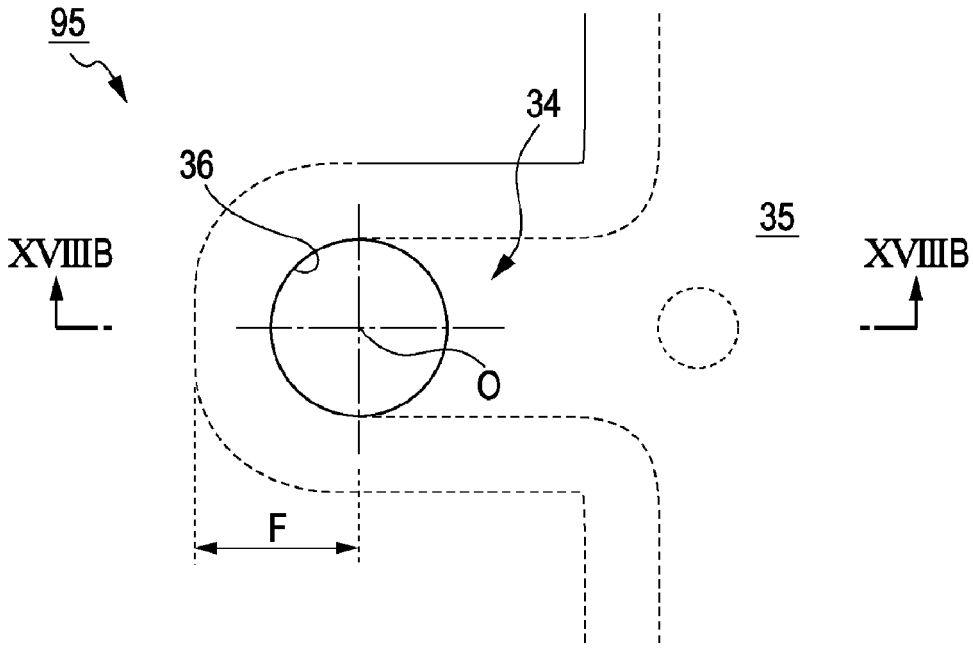
FIGS. 18A and 18B are cross-sectional views illustrating fabrication of a print head chip incorporated in a printer according to a sixth embodiment of the invention.
Figure 18B:
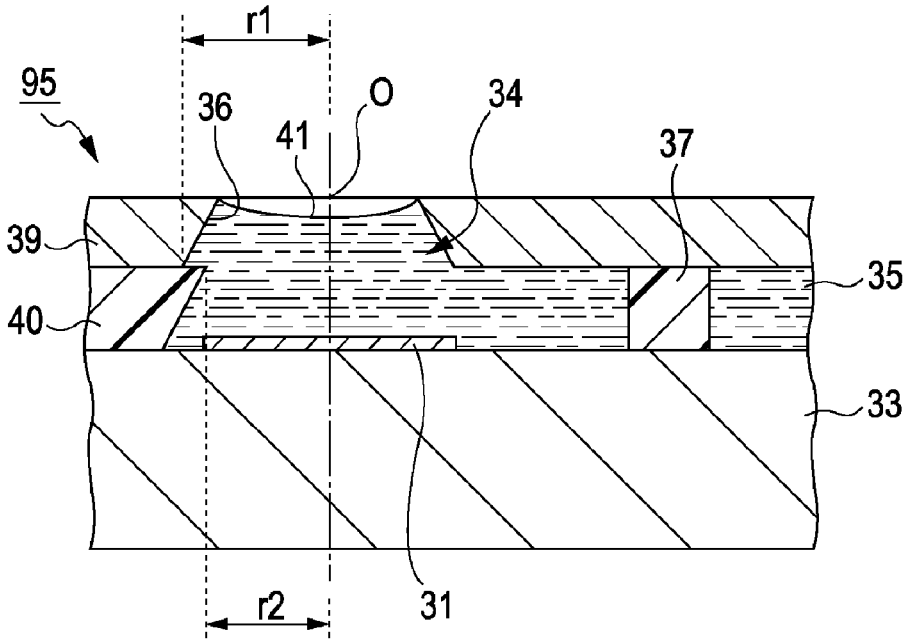

In the foregoing embodiment, if the ink reservoir and the nozzle are exposed separately, a stepped portion may be formed between a top plate 39 and a partition 40 due to misalignment of the mask as shown in FIG. 18B corresponding to FIG. 1B. If a print head chip is fabricated with a nozzle sheet attached thereto, an attachment error of the nozzle sheet may cause a stepped portion between the top plate 39 and the partition 40.

To address the problem of the stepped portion, in the present embodiment, a radius r1 of the nozzle 36 is set greater than the distance r2 from a center O of the nozzle 36 to the wall surface of the ink reservoir 34 in an end surface of the partition 40 at the side of the top plate 39 at a side opposite the ink channel 35 with respect to the center O of the nozzle 36. In particular, the value (r1−r2) obtained by subtracting r2 from r1 is set greater than the maximum amount of displacement expected to occur between the top plate 39 and the partition 40.

In the present embodiment, at a connecting portion of the ink reservoir and the nozzle, the nozzle is wider than the ink reservoir. With this configuration, formation of projections that impede the expelling of the air bubbles, dust or other foreign matter may be prevented even if the top plate 39 and the partition 40 are displaced from each other. In this manner, malfunctions caused by ingress of air bubbles, dust or other foreign matter into the liquid reservoir may be reduced.

As in the present embodiment, malfunctions caused by ingress of air bubbles, dust or other foreign matter into the liquid reservoir may be reduced also by setting the nozzle is wider than the ink reservoir at the connecting portion of the ink reservoir and the nozzle.

Seventh Embodiment

Although the tapered configuration of the wall surface of the ink reservoir or other components is determined by the focusing condition during exposure in the foregoing embodiments, the invention is not limited thereto. For example, the tapered configuration of the wall surface of the ink reservoir or other components may be determined by displacement of the mask during exposure.

Although the heater element is employed as the driving element in the foregoing embodiments, the invention is not limited thereto. Various driving elements including a piezoelectric element and an electrostatic actuator may also be used in the invention.

Although the foregoing description is given with reference to a line printer for color printing, the invention is not limited thereto. The invention may alternatively be applied to various printers including a line printer for black-and-white printing.

Although the foregoing description is given with reference to a printer, the invention is not limited thereto. The invention may also be applied to various devices including droplet discharging heads which discharges, for example, dyes or droplets of solution for forming a protective layer, a micro-dispenser which discharges droplets of test reagents, measuring devices, test equipment and pattern drawers.

The present application contains subject matter related to that disclosed in Japanese Priority Patent Application JP filed in the Japan Patent Office on Jul. 29, 2008, the entire content of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A droplet discharge head, comprising:

a plurality of elongate liquid reservoirs which hold a liquid;

a channel through which the liquid is guided to the liquid reservoirs, the liquid reservoirs extending from the channel;

a plurality of nozzles respectively located at ends of the liquid reservoirs located away from the channel; and a plurality of driving elements respectively located in the liquid reservoirs beneath the nozzles and which change the pressure in the liquid reservoirs so as to respectively discharge droplets of the liquid contained in the liquid reservoirs through the nozzles, wherein, the channel and the liquid reservoirs are aligned such that the liquid flows in the channel and in the liquid reservoirs along a same direction, and for each liquid reservoir and its respective nozzle, a wall surface of the liquid reservoir and a wall surface of the nozzle are coincident and arranged in a continuous line at a side opposite the channel with respect to the center of the nozzle as seen in a cross-sectional view through a central axis of the nozzle so as not to have a recess or a step portion.

2. The droplet discharge head according to claim 1, wherein, for each liquid reservoir and its respective nozzle, the wall surface of the liquid reservoir and the wall surface of the nozzle are configured such that a distance from the central axis of the nozzle to the liquid reservoir and to the wall surface of the nozzle becomes shorter toward the tip of the nozzle at the side opposite the channel.

3. The droplet discharge head according to claim 1, wherein, for each liquid reservoir and its respective nozzle, the liquid reservoir and the nozzle are formed by photolithography.

4. The droplet discharge head according to claim 1, wherein, for each liquid reservoir and its respective nozzle, the driving element is a heater element.

5. The droplet discharge head according to claim 1, wherein the liquid is ink.

6. The droplet discharge head according to claim 1, further comprising:

a plurality of first columns located in the channel, each first column extending along a direction in which the liquid flows, and a plurality of second columns respectively located in the channel in front of the liquid reservoirs.

7. A droplet discharging unit which includes a liquid discharging head for discharging desired droplets of a liquid, the liquid discharging head comprising:

a plurality of elongate liquid reservoirs which hold the liquid;

a channel through which the liquid is guided to the liquid reservoirs, the liquid reservoirs extending from the channel;

a plurality of nozzles respectively located at ends of the liquid reservoirs located away from the channel; and a plurality of driving elements respectively located in the liquid reservoirs beneath the nozzles and which change the pressure in the liquid reservoirs so as to respectively discharge the droplets through the nozzles, wherein, the channel and the liquid reservoirs are aligned such that the liquid flows in the channel and in the liquid reservoirs along a same direction, and for each liquid reservoir and its respective nozzle, a wall surface of the liquid reservoir and a wall surface of the nozzle are coincident and arranged in a continuous line at a side opposite the channel with respect to the center of the nozzle as seen in a cross-sectional view through a central axis of the nozzle so as not to have a recess or a step portion.

* * * * *